United States Patent [19]

Radler, Jr. et al.

[11] 4,025,188

[45] May 24, 1977

[54] PHOTOACTIVE DEVICE FOR XEROGRAPHY

[75] Inventors: Richard W. Radler, Jr.; Richard P. Millonzi, both of Marion, N.Y.

[73] Assignee: Xerox Corporation, Stamford, Conn.

[22] Filed: Nov. 25, 1974

[21] Appl. No.: 526,644

[52] U.S. Cl. ..... 355/16; 355/3 R

[51] Int. Cl.[2] ..... G03G 15/00

[58] Field of Search ..... 355/16, 3 BE, 3 R; 118/637

[56] References Cited

UNITED STATES PATENTS

| | | | |
|---|---|---|---|
| 3,697,160 | 10/1972 | Clark | 355/3 BE |
| 3,722,992 | 3/1973 | Zweig | 355/3 BE |
| 3,778,841 | 12/1973 | Gundlach | 355/3 BE |
| 3,790,273 | 2/1974 | Tanaka | 355/16 |
| 3,820,985 | 6/1974 | Gaynor | 355/3 BE |

*Primary Examiner*—R. L. Moses

*Attorney, Agent, or Firm*—James J. Ralabate; James P. O'Sullivan; John E. Crowe

[57] ABSTRACT

This application relates to a new way of carrying out xerographic functions while minimizing development and cleaning problems commonly associated with the photoreceptor surface and while maintaining excellent photoconductor efficiency and flex; and a device for carrying out the above purposes.

16 Claims, 7 Drawing Figures

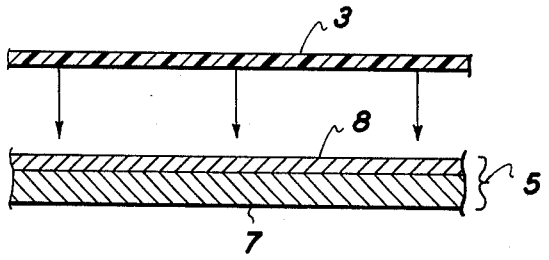
FIG. I
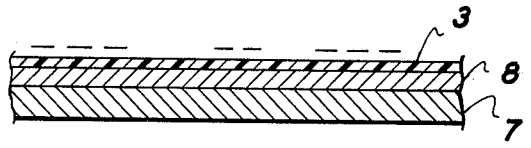
FIG. II
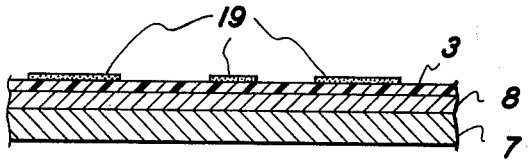
FIG. III
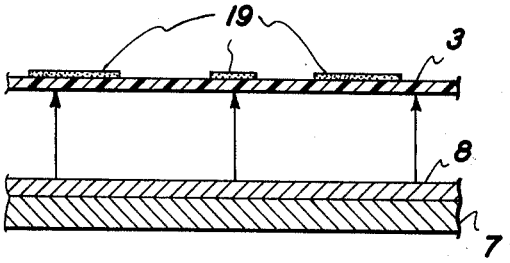
FIG. IV

FIG. V
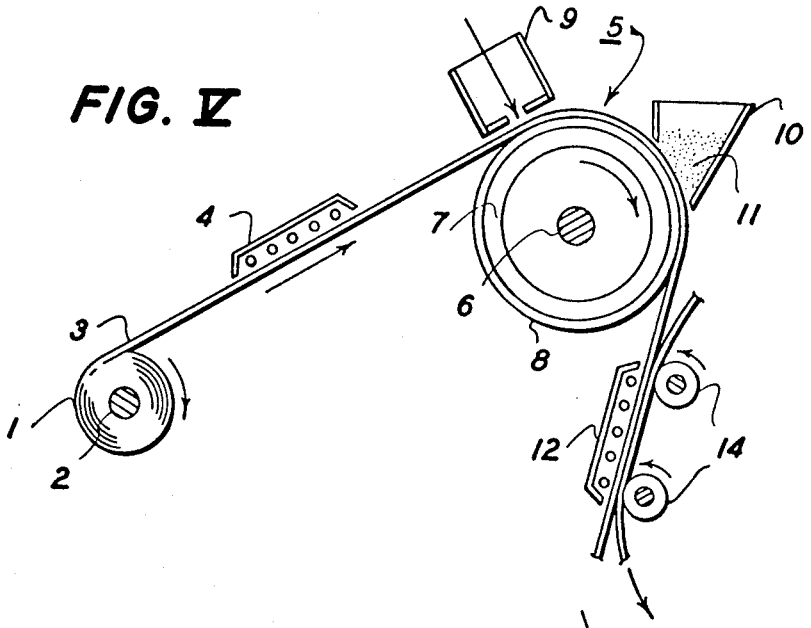
FIG. VI
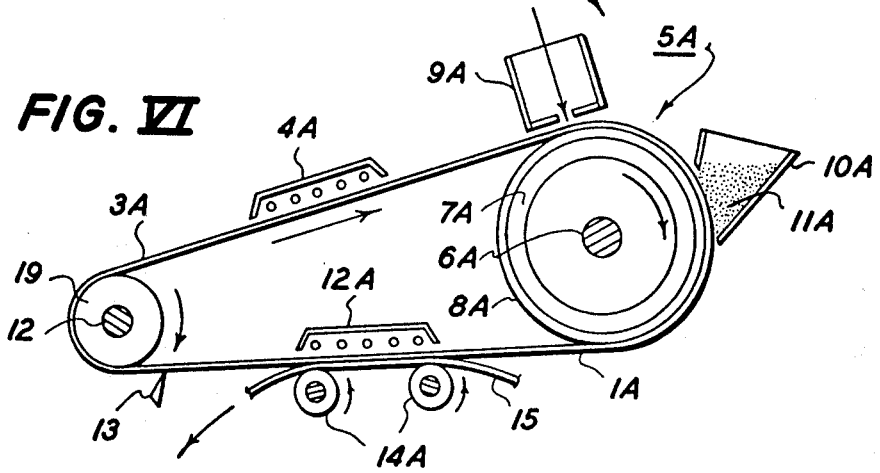
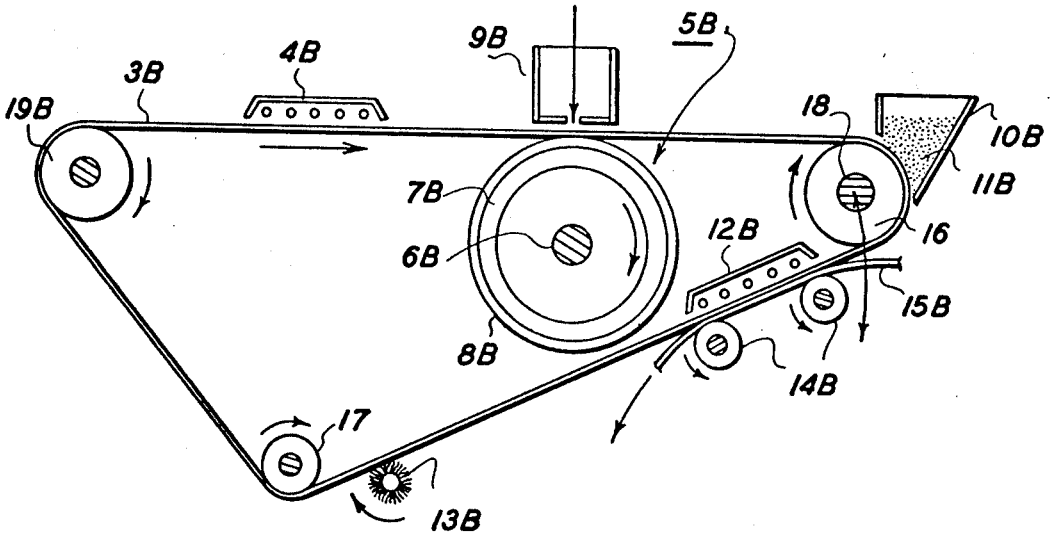
FIG. VII

PHOTOACTIVE DEVICE FOR XEROGRAPHY

BACKGROUND OF THE INVENTION

In the art of xerography, a xerographic plate containing a photoconductive insulating layer is imaged by first uniformly electrostatically charging its surface. The plate is then exposed to a pattern of activating electromagnetic radiation such as light, which selectively dissipates the charge in the illuminated areas of the photoconductive insulator while leaving behind a latent electrostatic image in the non-illuminated areas. This latent electrostatic image may then be developed to form a visible image by depositing finely divided electroscopic marking particles on the surface of the photoconductive insulating layer.

Photoconductive layers useful for xerographic purposes may be homogeneous layers of a single material such as vitreous selenium or may be composite layers containing a photoconductor and another material. One type of composite photoconductive layer used in xerography is illustrated by U.S. Pat. No. 3,121,006 to Middleton and Reynolds which describes a number of binder layers containing finely divided particles of a photoconductive inorganic compound dispersed in an electrically insulating organic resin binder. Such binder layers usefully contain particles of zinc oxide uniformly dispersed in a resin binder and is coated on a paper backing.

In the binder systems described in Middleton et al, the binder comprises a material which is incapable of transporting injected charge carriers generated by the photoconductor particles for any significant distance. As a result, such particles must be substantially in continuous particle-to-particle contact throughout the layer to permit sufficient charge dissipation for a stable cyclic operation. The uniform dispersion of photoconductor particles described in Middleton et al, therefore, requires a relatively high volume concentration of up to about 50 percent or more by volume of photoconductor in order to obtain sufficient photoconductor particle-to-particle contact for rapid discharge. It has been found, however, that high photoconductor loadings in the binder layers of the resin type also result in destruction of the physical continuity of the resin and significantly reduce the mechanical properties of the binder layer. Layers with high photoconductor loadings, therefore, are often characterized by a brittle binder layer. On the other hand, when the photoconductor concentration is reduced appreciably below about 50 percent by volume, the discharge rate is reduced, making high speed cyclic or repeated imaging difficult or impossible.

In a second Middleton et al patent another type of photoconductor is taught which utilizes a two phase photoconductive binder layer comprising photoconductive insulating particles dispersed in a homogeneous photoconductive insulating matrix. The photoconductor is in the form of a particulate photoconductive inorganic crystalline pigment broadly disclosed as being present in an amount from about 5 to 80 percent by weight. Photodischarge is believed caused by the combination of charge carriers generated in the photoconductive insulating matrix material and charge carriers injected from the photoconductive crystalline pigment into the photoconductive insulating matrix.

In U.S. Pat. No. 3,037,861 of Hoegl et al it is noted that polyvinyl carbazole exhibits some long-wave U.V. sensitivity such that its spectral sensitivity can be extended into the visible spectrum by the addition of dye sensitizers. Hoegl et al further indicates that additives such as zinc oxide or titanium dioxide may be used in conjunction with polyvinyl carbazole as a photoconductor.

Furthermore, certain specialized layered structures have been proposed for reflex imaging. For example, U.S. Pat. No. 3,165,405 to Hoesterey utilizes a two-layered zinc oxide binder structure for reflex imaging. In Hoesterey two separate continuous photoconductive layers having different spectral sensitivities are utilized to carry out a reflex imaging sequence. The Hoesterey device utilizes the properties of multiple photoconductive layers in order to obtain the combined advantages of the separate photoresponse of the respective photoconductive layers.

Although the above patents rely upon distinct mechanisms of discharge throughout the photoconductive layer, they generally suffer from common deficiencies in that the photoconductive surface during operation is exposed to the surrounding environment, and particularly in the case of cycling xerography, susceptible to abrasion, chemical attack, heat, and multiple exposures to light during cycling. These effects are characterized by a gradual deterioration in the electrical characteristics of the photoconductive layer resulting in the printing out of surface defects and scratches, localized areas of persistent conductivity which fail to retain an electrostatic charge, and high dark discharge.

In addition to the problems noted above, these photoconductive layers require that the photoconductor comprise either a hundred percent of the layer, as in the case of the vitreous selenium layer, or that they preferably contain a high proportion of photoconductive material in the binder configuration. The requirements of a photoconductive layer containing all or a major proportion of a photoconductive material further restricts the physical characteristics of the final plate, drum or belt in that the physical characteristics such as flexibility and adhesion of the photoconductor to a supporting substrate are primarily dictated by the physical properties of the photoconductor, and not by the resin or matrix material which is preferably present in a minor amount.

Another form of composite photosensitive layer utilizes a layer of photoconductive material covered with a relatively thick plastic layer and coated on a supporting substrate.

U.S. Pat. No. 3,041,166 of Bardeen describes such a configuration in which a transparent plastic material overlays a layer of vitreous selenium contained on a supporting substrate. The plastic material, as described, has a long range for charge carriers of the desired polarity. In operation, the free surface of the transparent plastic is electrostatically charged to a given polarity. The device is then exposed to activating radiation which generates a hole-electron pair in the photoconductive layer. The electron moves through the plastic layer and neutralizes a positive charge on the free surface of the plastic layer thereby creating an electrostatic image.

French Pat. No. 1,577,855 to Herrick et al also describes a special purpose composite photosensitive device adapted for reflex exposure by polarized light. One embodiment employs a layer of dichroic organic photoconductive particles arrayed in oriented fashion on a supporting substrate with a layer of polyvinyl carbazole formed over the oriented layer of dichroic material. When charged and exposed to light polarized perpendicularly to the orientation of the dichroic layer, the oriented dichroic layer and polyvinyl carbazole layer are both substantially transparent to the initial exposure light. When the polarized light hits the white background of the document being copied, the light is depolarized, reflected back through the device and absorbed by the dichroic photoconductive material. In another embodiment, the dichroic photoconductor is dispersed in oriented fashion throughout the layer of polyvinyl carbazole.

While the Bardeen and Herrick concepts are very advantageous, the fact remains that the inherent brittleness of the most efficient inorganic photoconductors continues to limit effective usage where high speed belt-type photoreceptors are needed.

OBJECTS OF THE INVENTION

It is an object of the present invention to obtain a novel efficient xerographic photoreceptor device or system utilizing a charge conductive matrix in selective contact with a second photoreceptor element comprising a photoconductor layer and a base or substrate layer substantially in an area of image exposure.

It is a further object of this invention to find a method for improving the durability and life of a xerographic system comprising a base or substrate, a charge- or hole-generating photoconductive layer and removable matrix material.

THE INVENTION

The foregoing objects and others are accomplished in accordance with this invention by utilizing a xerographic system comprising a removable charge- or hole-conductive matrix, such as a movable flexible belt or plate, comprising charge-transporting matrix material inclusive of dmensionally stable matrix material; a plate, screen, axially rotatable drum, flexible belt arranged in at least partial temporary contact with the matrix and comprising a base and at least one externally applied charge- or hole-generating photoconductive coat, the plate, screen or axially rotatable drum preferably being in at least movable tangent line contact with the charge conductive matrix; an electrostatic charging means arranged in charging relation to a free surface of the matrix; means for imagewise exposing the charge- or hole-generating photoconductive coat while in contact with the matrix; and means for developing and transferring or transferring and developing the resulting image from the matrix. Also conveniently included are usual means for fixing or fusing the developed image onto a suitable backing.

The system, as described, permits maintaining the matrix material in charge transferring contact with the photoconductive layer essentially in an area of image exposure.

The invention is further embodied in accompanying FIGS. I–VII, in which FIGS. I–IV, in sequence, schematically demonstrate a partial stepwise progression of a xerographic imaging process of which FIG. I is a schematic cross section of a base or substrate 7 with a charge generating photoconductive layer 8 in contact therewith and matrix material 3 not yet in the desired temporary contact with charge generating layer 8;

FIG. II demonstrates in schematic cross section the combined charged, and image-wise-exposed components of FIG. I, with a latent electrostatic image represented on the active matrix layer 3;

FIG. III further represents the elements of FIGS. I and II in schematic cross section with a corresponding positive toner image 19;

FIG. IV represents the active matrix layer 3 with a fixed or transferable positive toner image 19 separated from the reusable combined substrate 7 and charge generating layers 8;

FIG. V represents a somewhat more sophisticated separate embodiment of the present in schematic cross section showing a rotatably mounted expendable or consumable supply roll 1 of flexibile charge transfer matrix material 3; a corotron charging means 4; an image exposure station 9; an axially rotatably mounted photoconductor drum 8 comprising mounting means 6 a substrate 7 and a photoconductor layer 8; a developing station 10; and image transfer means 12;

FIG. VI represents schematic cross section of a modification of the embodiment of FIG. V, in which the expendable matrix supply roll is replaced with a continuous movable belt of charge conductive matrix material supportably and movably mounted on the drum and on a supporting roller; the belt as described is served by a contacting blade 13 as cleaning means at a point beyond the image transfer means 12A; and FIG. VII represents a still further modification of FIGS. V and VI in schematic cross section, in which the charge conductive matrix supply roll is replaced with a belt 3B on guide rollers 19B, 16 and 17; the belt is in adjustable contact with respect to the photoconductor drum and is contacted with rotating brush 13B as cleaning means at a point beyond the image transfer means 12B.

Looking to FIG. V in further detail, we find a matrix supply roll 1 consisting of a rotatable mounted spool 2 and a belt of charge transfer matrix material 3 led past a corotron charging station 4 in supported contact with a rotatably mounted photoconductor drum or plate 5 having an axle 6 a base 7 and a charge generating photoconductor layer 8; the charge conductive matrix belt is in, at least, tangent contact with the drum 5 at image exposure station 9. The resulting latent electrostatic image on the upper surface of the belt is developed at toner developing station 10 with toner and carrier particles 11 of the usual type, and the developed image is then transferred to a suitable surface such as paper at transfer station 12. Not shown are drive and take up means for effecting movement of the belt 3 from the spool 2 to a discard spool (also not shown).

In FIG. VI a continuous charge transfer matrix belt 3A is rotatably mounted on roller 19 and drum 5A, the belt being charged at station 4A, image exposed at station 9A, the resulting image toner developed at developing station 10A and the resulting image transferred to a paper or other suitable media 15 at transfer station 12A. The belt is then cleaned by a blade cleaning means 13 prior to recycling. In this figure the "A" items can be identical with the corresponding numbers of FIG. I or known equivalents or modified equivalents thereof.

In FIG. VII a continuous charge transfer matrix belt 3B is movably and supportively engaged with guide rollers 19B, 16 and 17, charged at station 4B, the area of contact with photoconductor at exposure station 9B being conveniently determined by vertical adjustment of the axis 18 of guide roller 16. As in FIG. VI, the numbers identified with a B designation can be identical or equivalent to the corresponding numbers in the preceding figures except where otherwise indicated.

For purposes of the present invention, the charge- or hole-conductive matrix material 3, 3A or 3B used in the flexible belt or as shown in FIG. I–VII is usefully from about 10–100$\mu$ or even thicker, and can comprise any one of a number of suitable transparent organic polymeric elements which are capable of supporting the injection of photo-excited holes from a photoconductive pigment and permit the transport of these holes through the active matrix to selectively discharge a surface charge. Polymers having this characteristic have been found to contain repeating units of a polynuclear aromatic hydrocarbon which may also contain heteroatoms such as; for example, nitrogen, oxygen, or sulfur. Typical polymers include poly-N-vinyl carbazole (PVK), poly-1-vinyl pyrene (PVP), poly-9-vinyl anthracene, polyacenaphthalene, poly-9-(4-pentenyl)-carbazole, poly-9-(5-hexyl)-carbazole, polymethylene pyrene, poly-1-(pyrenyl)-butadiene and N-substituted polymeric acrylic acid amides of pyrene. Also included are derivatives of such polymers including akyl, nitro, amino, halogen, and hydroxy substituted polymers. Typical examples are poly-3-amino carbazole, 1,3-dibromo-poly-N-vinyl carbazole and 3,6-dibromo-poly-N-vinyl carbazole in particular derivatives of the formula:

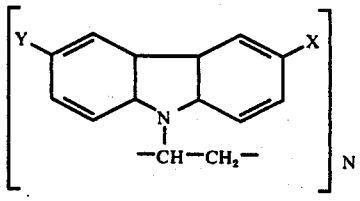

where X and Y are substituents and N is an integer. Also included are structural isomers of these polymers, typical examples include poly-N-vinyl carbazole, poly-2-vinyl carbazole, and poly-3-vinyl carbazole. Also included are copolymers; typical examples are N-vinyl carbazole/methyl acrylate copolymer and 1-vinyl pyrene/butadiene ABA, and AB block polymers. Typical nonpolymeric materials include carbazole, N-ethylcarbazole, N-phenylcarbazole, pyrene, tetraphene, 1-acetylpyrene, 2,3-benzochrysene, 6,7-benzopyrene, 1-bromopyrene, 1-ethylpyrene, 1-methylpyrene, perylene, 2-phenylindole, tetracene, picene, 1,3,6,8-tetraphenyl-pyrene chrysene, fluorene, fluorenone, phenanthrene, triphenylene, 1,2,5,6-dibenzanthracene, 1,2,3,4-dibenzanthracene, 2,3-benzopyrene, anthraquinone, dibenzothiophene, naphthalene, and 1-phenylnaphthalene. Due to the poor mechanical properties of some of the above material they are preferably used in conjunction with either an active polymeric material or a non-active polymeric binder. Typical examples include suitable mixtures of carbazole in poly-N-vinyl carbazole as an active polymer and carbazole in a non-active binder. Such non-active binder materials include polycarbonates, acrylate polymers, poly amides, polyesters, polyurethanes, and cellulose polymers.

It is not the intent of the present invention to restrict the type of polymer which can be employed as a belt or plate of charge conductive matrix material. Polyesters polysiloxanes, polyamides, polyurethanes and epoxies as well as block, random, or graft copolymers (containing the aromatic repeat unit) are exemplary of types of polymers which can be employed. In addition, suitable mixtures of active polymers with inactive polymers or non-polymeric materials can be employed. Furthermore, certain non-active materials are useful as plasticizers to improve the mechanical properties of the active polymer layer.

Even more important, in this regard, is the utilization of polymeric orientation (i.e. stretching) of the matrix belt to obtain the necessary flexibility and durability. In particular, it is found that biaxial orientation of a photoreceptor is preferably carried out by conventional means such as "tentering" or "bubble" techniques. Suitable devices for this purpose are demonstrated, for instance, on pages 345–346 and 348–350 of "The Encyclopedia of Polymer Science and Technology", Volume 2.

For purposes of the present invention, the heating and stretch orienting steps can also be preceded by a preliminary heating and/or annealing step to assure good anchorage of holding clips, particularly when a tentering technique is to be utilized. In either case, however, a matrix belt having brittle, essentially unoriented polymer-containing components must be heated to a sufficiently high temperature to permit stretch orientation in the indicated amount without (1) unduly weakening the film at the anchoring points, or (2) cause a tearing elsewhere in the belt or film. This is conveniently accomplished, for instance, by blowing hot air onto the belt before and during stretching, by utilizing infrared lamps, or by using a combination of the above two or other art-recognized heating steps compatible with the softening and crystallographic properties of the components.

Althouth the optimum temperature will vary somewhat, depending upon the polymer utilized, it is found (ref. supra) that a temperature range of about 10°–50° C. above the glass transition temperature is satisfactory for most polyvinyls having the desired characteristics. Moreover, a relatively narrow temperature band above and below this range will cover most of the remaining polymeric materials known to the art and useful for xerographic purposes. For instance, an unoriented film containing a substantial or major amount of a poly-N-vinyl carbazole with a number average molecular weight of about 100,000 to about 2.5 million, is best heated to a temperature range of about 200°–260° C. Polyvinyl pyrenes having molecular weights of about 300,000 to 1.5 million however, are preferably heated to a temperature slightly overlapping this range on the low side with respect to molecular weights less than 1 million.

An electrostatic charging mean suitable for purposes of the present invention can be a high voltage corotron of the usual type including devices such as disclosed in U.S. Pat. Nos. 3,566,108, 3,723,793, 3,612,864, 2,885,556, 2,588,699 and 2,777,957.

The axially rotatable drum or plate (ref. FIG. I or V–VII) used in this invention (i.e., the base or substrate) can be essentially a xerographic metal charge conductive drum, flexible belt, sleeve, web, metal or metal-covered glass plate, or charge conductive screen, etc., of convenient thickness, provided that contact with one surface of the matrix is coincident with an area of image exposure (ref. 9, 9A, 9B of FIGS. V–VII). Typical bases or substrates 7 comprise aluminum, steel, brass, or the like. The base or substrate, however, can also comprise (a) a composite structure such as a thin conductive coating contained on a paper base; (b) a plastic coated with a thin conductive layer such as aluminum or copper iodide; or (c) glass coated with a thin conductive coating of chromium or tin oxide. When using a transparent substrate, however, it should be understood that imagewise exposure may optionally be carried out through the substrate or back of the imaging member.

The choice of a drum or alternatives as above described depends largely on the type of charge- or hole-generating layer employed (ref. No. 8, 8A, 8B or FIGS. I–VII). Preferably, however, the charge- or hole-generating layer consists of an inorganic material such as an inorganic photoconductive glass. Suitable inorganic photoconductive materials capable of injecting both hole and electrons including amorphous selenium ($0.4\mu - 2\mu$), and selenium alloys such as senenium-tellurium and selenium-arsenic. Selenium may also be used as a crystalline form known as trigonal selenium. Also includible are relatively thin (i.e., about $0.4\mu - 2\mu$) layers of organic pigments such as the X-form of metal free phthalocyanines, which are capable of injecting only holes. Suitable materials are described, for instance, in U.S. Pat. No. 3,357,989 to Bryne et al. Also included are metal phthalocyanines, such as copper phthalocyanine; quinacridones available from DuPont, for instance, under the tradename Monastral Red, Monastral Violet, and Monastral Red Y; also included are substituted 2,4-diaminotriazines of the type disclosed by Weinberger in U.S. Pat. No. 3,445,227; triphenodioxazines (Weinberger U.S. Pat. No. 3,442,781) and also polynuclear aromatic quinones available from Allied Chemical Corp. under the tradename Indofast Double Scarlet, Indofast Violet Lake B, Indofast Brilliant Scarlet, and Indofast Orange.

Inorganic photoconductive material can be conveniently applied onto a substrate by the usual vacuum coating techniques while organic hole generating materials such as the X-form of metal free phthalocyanine can be conveniently disposed into an organic solvent such as cellosolve, and then coated onto an aluminum or other substrate by means of a Bird Applicator to obtain a particulate layer (preferably about 1 $\mu$ thick), of the pigment. The layer is then baked out at 100° C. to ensure removal of the solvent. When desired, a self-supporting film such as a 10 to 50 $\mu$ layer of poly-N-vinylcarbazole is then mechanically placed on top of the phthalocyanine particles and corona-charged negatively in a field of about 20 – 80 volts per micron. On exposure to light (monochromatic or white) a photodischarge results which has characteristics similar to the conventional PVK/phthalocyanine sandwich layer. Organic charge-generating photoconductor particles of the above type can also be conveniently incorporated into a binder composition such as disclosed in U.S. Pat. No. 3,640,710, in a preferred ratio of about 1:3 – 6 parts by weight of particle-to-binder. The above list of photoconductors should not be taken as limiting with respect to thickness or otherwise, but is merely illustrative of suitable materials.

In each case, however, the charge generating material must be capable of injecting either or both photoexcited holes or charges into the matrix.

The means for exposing the active matrix layer or belt at a point corresponding to the point or moving line of contact with the drum, belt, etc. (ref. 5, 5A, 5B; FIGS. V–VII) can be the usual optical type (ex. mirror-lens combination) in which the mirror rotation or scan is in sync with the movement of the charge transfer matrix belt at the movable line of contact with the drum or its equivalents as described above. Also preferred, but not shown is a flash exposure device for the entire plate (ref. FIG. III).

Developing means can be of the usual type inclusive of liquid or solid developer with dispensing and control devices as described, for instance, in U.S. Pat. Nos. 25,136, 2,638,416, 2,784,109, 2,892,709, 2,930,351, 3,084,043, 3,094,049, 3,301,152, 3,348,521, 3,453,045, 3,542,406, and 2,573,881.

Image transfer devices suitable for use in the present invention can be of the usual type using pressure and/or corotron charging devices.

Belt cleaning means within the scope of the present invention can include cleaning blades of the usual type as described for instance in U.S. Pat. Nos. 3,795,025, 3,660,863, 3,682,689, 3,552,850 and/or rotating brushes as described, for instance, in U.S. Pat. No. 2,751,616 and optionally with wax or lubricants as suggested in U.S. Pat. No. 2,901,348.

Additional modifications and embodiments within the scope of the present invention can be exemplified, for instance, by precoating a charge (hole) generating layer (a photoactivator layer) onto a belt or disposable matrix roll such as polyvinyl N-carbazol), positively charging the belt and then contacting a drum, web or plate substrate at least at the point of image exposure. The resulting latent image transfer can be developed, in situ, or preferably transferred and developed in the usual way, depending upon the cost and durability of the charge generating layer utilized.

Transparencies can also be easily obtained in accordance with the present invention by utilizing a "one use" consumable transparent film or belt as the active matrix, and developing and fixing the image thereon. If, on the other hand, an opaque active matrix is used (i.e., pigmented, dyed or crazed) along with a transparent substrate (ex. NESA) and exposed through the base or substrate (now shown), the fixed image on the active matrix can also serve as a final copy.

What is claimed is:

1. A xerographic system comprising:

a removable electron- or hole-conductive matrix;

a plate, screen, flexible belt or axially rotatable drum comprising a base and at least one externally applied photoconductive coat and arranged in temporary contact with the matrix essentially only in an area of image exposure;

an electrostatic charging means arranged in charging relation to the free surface of the matrix out of contact with the photoconductive coat;

means for imagewise exposing the photoconductive coat while in contact with the matrix; and means for developing or transferring and developing the resulting image.

2. A xerographic system of claim 1 wherein the removable conductive matrix is a flexible belt in at least tangential contact with the photoconductive coat.

3. A xerographic system of claim 1 wherein the base and at least one externally applied photoconductive coat is in the form of a plate.

4. A xerographic system of claim 1 wherein the removable charge- or hole-conductive matrix is a consumable.

5. A xerographic system of claim 4 wherein the removable charge- or hole-conductive matrix is essentially transparent.

6. The xerographic system of claim 2 wherein the flexible matrix belt consists essentially of an axially oriented charge conductive polymeric matrix material having a number average molecular weight of about 100,000 to about 2.5 million.

7. The system of claim 2 wherein the flexible belt is biaxially oriented.

8. The xerographic system of claim 6 wherein the axially rotatable drum comprises a charge conductive substrate and a selenium-containing photoconductive layer.

9. The xerographic system of claim 1 wherein the photoconductive coat comprises a metal free phthalocyanine layer.

10. The system of claim 1 wherein a photoconductive coat is externally applied onto a metal belt.

11. The system of claim 1 wherein the photoconductive coat is externally applied onto a metal coated belt.

12. A xerographic system having in combination a movable flexible belt comprising a dimensionally stable electron or hole conductive matrix material;

an axially rotatable drum having a cylindrical element comprising a base and at least one externally applied photoconductor layer, the drum being in at least rotatable tangent line contact with the movable charged belt;

an electrostatic charging means in charging relation to an external surface of the belt;

means for imagewise exposing the photoconductor layer of the drum while in contact with the flexible belt;

means for developing, or transferring and developing, the resulting latent electrostatic image; and means for transferring the resulting developed image onto a suitable backing.

13. The xerographic system of claim 12 wherein the axially rotatable drum comprises a charging conductive substrate and a selenium-containing charge generating photoconductive layer.

14. The system of claim 12 wherein the belt is cleaned subsequent to image transfer by contact with a cleaning means.

15. The system of claim 14 wherein the cleaning means is one or both of a blade and a rotating brush.

16. A xerographic system comprising a plate, screen, flexible belt or axially rotatable drum comprising:

a base and at least one externally applied photoconductive coat;

a removable electron- or hole-conductive matrix in the form of a flexible belt consisting essentially of an axially oriented charge conductive polymer having a number average molecular weight of about 100,000 to about 2.5 million, and comprising at least one of poly-N-vinylcarbazole, poly-1-vinylpyrene, poly-9-vinylanthracene, polyacenaphthalene, poly-9-(4-pentenyl)carbazole, poly-9-(5-hexyl)carbazole, polymethylene pyrene, or corresponding n-substituted polymeric acrylic acid amide of pyrene, said belt being arranged in at least tangential temporary contact with the photoconductive coat;

an electrostatic charging means arranged in charging relation to a free surface of the matrix;

means for imagewise exposing the photoconductive coat while in contact with the matrix; and means for developing, or transferring and developing the resulting image.

* * * * *